US006226818B1

(12) United States Patent
Rudick

(10) Patent No.: US 6,226,818 B1
(45) Date of Patent: May 8, 2001

(54) MULTIPLE FIRMNESS PILLOW

(76) Inventor: Maly Rudick, 9769 NW. 48 Ter., Miami, FL (US) 33178

( * ) Notice: Subject to any disclaimer, the term of this patent is extended or adjusted under 35 U.S.C. 154(b) by 0 days.

(21) Appl. No.: 09/405,069

(22) Filed: Sep. 27, 1999

(51) Int. Cl.[7] ..... A47G 9/00
(52) U.S. Cl. ..... 5/636; 5/638; 5/640
(58) Field of Search ..... 5/640, 636, 638, 5/644, 490, 657, 727, 740, 722

(56) References Cited

U.S. PATENT DOCUMENTS

| | | | | |
|---|---|---|---|---|
| 716,752 | * | 12/1902 | Phillips | 5/655.3 |
| 830,970 | | 9/1906 | Cary . | |
| 2,765,480 | * | 10/1956 | Mueller | 5/640 |
| 2,810,920 | | 10/1957 | Carruth . | |
| 2,952,856 | | 9/1960 | Ruff . | |
| 3,009,172 | | 11/1961 | Eidam . | |
| 3,315,282 | | 4/1967 | Lowery . | |
| 3,694,831 | | 10/1972 | Treace . | |
| 4,274,673 | | 6/1981 | Kifferstein . | |
| 4,345,345 | | 8/1982 | Holtz . | |
| 4,503,396 | * | 3/1985 | Ritchie et al. | 5/631 |
| 4,780,920 | | 11/1988 | White . | |
| 5,044,026 | * | 9/1991 | Matthews | 5/644 |
| 5,864,904 | | 2/1999 | Rudick . | |

FOREIGN PATENT DOCUMENTS

| | | |
|---|---|---|
| 2130086 | 5/1984 | (GB) . |

* cited by examiner

*Primary Examiner*—Lynne H. Browne
*Assistant Examiner*—Fredrick Conley
(74) *Attorney, Agent, or Firm*—Richard C. Litman

(57) ABSTRACT

A generally square or rectangular multiple firmness pillow includes a relatively firmer fill material placed toward one diagonal corner thereof. The multiple firmness pillow may be used in pairs with the portions of firmer fill material facing one another and separated by a small distance to provide support for the face of a person sleeping or resting in the prone position, and support the face and head above the underlying surface to provide a breathing space for the face-down person. The present pillows may be filled with loose fill materials of different firmnesses, such as shredded foams, synthetic fibers and feathers, with an internal divider separating the two fill materials, or may be filled using molded resilient foam materials molded or cut as a single cohesive unit.

8 Claims, 2 Drawing Sheets

MULTIPLE FIRMNESS PILLOW

BACKGROUND OF THE INVENTION

1. Field of the Invention

The present invention relates generally to articles and furnishings for use in resting and sleeping, and more specifically to a pillow having at least two different fill materials providing different levels of firmness in different areas of the pillow. The present multiple firmness pillow is particularly adapted for use as an inner pillow with the pillow covers or cases described in U.S. Pat. No. 5,864,904 issued on Feb. 2, 1999 to the present inventor, and incorporated herein by reference.

2. Description of the Related Art

Conventional pillows are not well adapted for a person who prefers to sleep in the prone (i.e., face down) position, as opposed to those who sleep in the supine (lying upon the back) position, or resting upon one's side. Such conventional pillows require the sleeper to turn the head to the side in order to breathe, due to the continuous soft and resilient nature of the pillow which essentially surrounds the portion of the head or face placed thereon. This may result in muscular cramps and a stiff neck for the sleeper upon arising, due to the continuous strain placed upon the neck while sleeping in the prone position for hours.

This problem has been recognized in the past, and many persons have attempted to develop solutions for it, as exemplified in the related art discussed further below. These pillows and the like of the prior art, generally provided a pillow or pillows, mattress structure, etc. with a gap in the center thereof, in which a resting person could place his/her face while in a prone position during rest or sleep. However, such pillows generally follow conventional pillow practice of the prior art, and are relatively soft and compliant. Thus, the weight of a person's head resting upon the sides of the pillow, result in the face sinking downwardly between the pillows to the extent that the resting person's face contacts the underlying structure, thus resulting in no real improvement in the situation where the resting person wishes to assume a prone position and yet requires a clear airway for breathing while prone.

Accordingly, a need will be seen for a pillow which is provided with different fill material, to provide dual firmness areas in the pillow. With two such dual firmness pillows, a resting person may position the pillows in a mirror image relationship to one another, with their firmer areas slightly spaced apart but facing one another. In this manner, a resting person may position their upper face and forehead to rest upon the areas of the pillows having the greater firmness, with those firmer areas supporting the weight of the head and holding the head clear of the mattress, bedding, or other underlying structure.

A discussion of the related art of which the present inventor is aware, and its differences and distinctions from the present invention, is provided below.

U.S. Pat. No. 830,970 issued on Sep. 11, 1906 to Benjamin F. Cary, titled "Sham Pillow," describes a device comprising two relatively thin and stiff backing plates with upturned edges (shown in FIG. 4 of the document), and filled with a soft, resilient material. The two backing plates are secured together by hinges. As such, the Cary sham pillow is more closely related to the interconnected dual pillow covers of U.S. Pat. No. 5,864,904 issued to the present inventor and discussed further below, than to the present multiple firmness pillow invention. Cary does not disclose any specific fill material for his sham pillow, nor does he suggest the use of multiple fill materials of different densities or firmnesses, as provided by the present invention.

U.S. Pat. No. 2,810,920 issued on Oct. 29, 1957 to Walter T. Carruth, titled "Mattress," describes a mattress having a rectangular recess in the head end thereof, in which a pair of spaced apart inserts or a single insert of substantially the same size as the recess, may be placed. A board is provided beneath the head end of the mattress, with a removable panel. The Carruth mattress is adapted to allow an ill person lying prone thereon, to expectorate or vomit through the recess and opening in the underlying board. No suggestion is made of any dual firmness material in any of the inserts of the Carruth mattress attachments.

U.S. Pat. No. 2,952,856 issued on Sep. 20, 1960 to Clarence B. Ruff, titled "Adjustable Pillow Support," describes a pair of pillows comprising inflatable or stuffed bladders or casings, with a cover which may be secured between the two. The cover includes a sheet of material extending between the individual covers or cases for the two pillows. While Ruff notes that the pillows may be inflated or stuffed with other material in order to vary their firmness, he makes no suggestion of any provision for multiple firmness materials being placed in one or both of the pillows, or of any partition within either or both pillows for separating bladders or compartments containing fill material of different firmnesses or inflated to different pressures.

U.S. Pat. No. 3,009,172 issued on Nov. 21, 1961 to Frances H. Eidam, titled "Head Suspending Pillow," describes a pillow having a triangular cross section with three different firmnesses of material therein. A relatively hard triangular wedge of material serves as a base for the pillow, with a pad of material having a medium firmness being placed over the lower or thinner portion of the harder material. A third material having softer properties is placed atop the thicker area of the hardest or firmest material. A U-shaped cutout is formed vertically through the thickest portion of the pillow. The Eidam pillow is adapted to cradle the head in the U-shaped portion while providing minimum contact with curlers, pins, or other devices placed in the hair. However, the Eidam pillow is not well adapted for holding the head well clear of the mattress or other underlying surface, as the portion of the pillow in contact with the head is relatively soft but supported by a firmer material therebeneath. In contrast, the present multiple firmness pillow provides a relatively firm fill material for placement beneath the head, which firm fill material extends completely from the upper portion to the lower portion of the pillow. In other words, the divisions between the fill materials in the present pillow are disposed vertically, rather than primarily angularly, as in the Eidam pillow. Moreover, the Eidam pillow is not configured for installation in a generally rectangular pillow cover or case such as the pillow cover of the U.S. Pat. No. 5,864,904 issued to the present inventor, with which the present multiple firmness pillow is compatible.

U.S. Pat. No. 3,315,282 issued on Apr. 25, 1967 to Andrew Lowery et al., titled "Headrest For Cosmetic Use And The Like," describes two embodiments of a generally wedge shaped pillow, having a configuration and function generally along the lines of the pillow of the '172 Patent to Eidam, discussed immediately above. The same points of distinction noted between the Eidam pillow and the present invention, are seen to apply here as well. Moreover, the Lowery et al. pillow includes a central passage for the face of the user, with a hard shell being provided to support an opening thereunder for breathing. Lowery et al. use hard shells of material in other areas of their pillow, as well. The Lowery et al. pillow, as well as the Eidam pillow discussed above, are incapable of being used with a conventional pillowcase, as opposed to the present, generally rectangular multiple firmness pillow.

U.S. Pat. No. 3,694,831 issued on Oct. 3, 1972 to Harry T. Treace, titled "Medical Head Support," describes a pillow having opposed wedge shaped upper surfaces for cradling the head, with a central opening through the base portion of the pillow. The upper surfaces of the pillow are covered with a thin layer of relatively softer foam material. However, the Treace pillow is adapted particularly for use in the medical field, for supporting the head during ear or neurosurgery. Treace states that the softer foam material is sufficiently porous to allow a face down user to breathe therethrough. This is necessary, because the central passage does not communicate with the exterior of the pillow through the side(s). Thus, it does not provide a breathing passage for a person lying face down upon the pillow, as the upper portion is blocked by the user's head and face, and the lower portion is blocked by the underlying surface. Accordingly, Treace must provide a softer, breathable foam material in the upper layer of his pillow, whereas the present multiple firmness pillow provides a relatively firm portion in one corner thereof, which extends completely from top to bottom of the pillow for providing good head support and holding the head clear of the underlying surface. Two such pillows of the present invention, when spaced a few inches apart from one another, provide clearance for breathing therebetween, and can be used with the pillow covers of the '904 U.S. Patent to the present inventor, unlike the Treace pillow, which cannot be used with a conventional, generally rectangular pillowcase.

U.S. Pat. No. 4,274,673 issued on Jun. 23, 1981 to Harry B. Kifferstein, titled "Disposable Adjustable Headrest And Pillow," describes a pair of pillows for placement in a relatively large pillowcase. Kifferstein describes various arrangements of the two pillows and the pillowcase in which the pillows are installed adjacent one another or separated by some distance. When the two pillows are somewhat separated from one another, the pillowcase extends between them, forming a connecting web. This web is disposed approximately medially relative to the height of the pillows, and thus does not provide clearance for the face of a person lying face down upon the pillows, as does the present invention. Moreover, Kifferstein does not suggest the use of different firmnesses of fill material in his pillows, as provided by the present multiple firmness pillow.

U.S. Pat. No. 4,345,345 issued on Aug. 24, 1982 to Leonard Holtz, titled "Head Support," describes various embodiments of pairs of interconnecting straps for securing two pillows together. Thus, the Holtz head support invention is more closely related to U.S. Pat. No. 5,864,904 previously issued to the present inventor, than to the present invention. Holtz notes that the pillows may be inflated with air, or may be stuffed with a loose or cohesive solid fill material. However, Holtz does not make any suggestion of the installation or use of two or more different fill materials having different firmnesses, as provided by the present multiple firmness pillow invention.

U.S. Pat. No. 4,780,920 issued on Nov. 1, 1988 to Aaron L. White, titled "Angular Sleeper's Pillow And Pillowcase," describes a specially shaped pillow having a depending area to one side thereof, for supporting the head of a user when the user's head is not symmetrically placed upon the pillow. White notes that two such pillows may be secured symmetrically together, by means of a specially formed pillowcase. However, the White pillow cannot be adapted for placement within a conventional rectangular pillowcase, as can the present pillow. Moreover, the White pillow does not include multiple fill materials having different firmnesses, as does the present multiple firmness pillow.

U.S. Pat. No. 5,864,904 issued on Feb. 2, 1999 to the present inventor, titled "Bed Pillow," describes pillows encased in a pair of interconnected pillow covers, which in turn have protective pillowcases removably installed thereover. The outer pillowcases include bottom openings therein, for stuffing the pillows and their pillow covers into the cases and still providing clearance for the interconnecting strap between the pillow covers. The present inventor's '904 U.S. Patent notes the importance of providing sufficient firmness for the pillows to hold the user's face clear of the underlying surface when in a prone position, and suggests the use of multiple pillows stuffed within each pillow cover to provide the desired firmness. However, no mention is made in the present inventor's issued patent of any provision for pillows having multiple firmness, as provided by the present invention.

Finally, British Patent Publication No. 2,130,086 published on May 31, 1984 to James Putnam, titled "Improvements Relating To Back Supporting Cushions For Seats," describes a back support cushion having a rigid (i.e., plywood) back surface supporting a cushion with a raised central portion for supporting the spine and opposed raised lateral bolster areas. Putnam notes that the side supports or bolsters are preferably of a harder material than the remainder of the cushion, but the Putnam cushion cannot be used to support the head of a prone sleeper to allow the sleeper to breathe. In contrast, the present pillow, with its firmer fill offset to one corner, is particularly adapted for use with a mating such pillow for supporting the head of a prone sleeper therebetween.

None of the above inventions and patents, either singly or in combination, is seen to describe the instant invention as claimed.

SUMMARY OF THE INVENTION

The present invention comprises a multiple firmness pillow for persons preferring to sleep or rest in a prone position, i.e., face down. The present pillow includes at least two different fill materials having different firmnesses, with a firmer material disposed generally to one corner of the square or rectangular pillow. Two such pillows, when placed in mirror image to one another with the firmer fill materials facing one another and spaced apart by a small distance, provide good support for the face of a user, supporting the face well clear of the underlying surface (mattress, etc.) so the user may breathe freely.

The present multiple firmness pillow is well adapted for use with the interconnected pillow covers and pillowcases disclosed in U.S. Pat. No. 5,864,904 issued on Feb. 2, 1999 to the present inventor, and incorporated herein by reference. The interconnected pillow covers of the '904 U.S. Patent secure the pillows therein at the preferred distance from one another, and define a breathing space therebetween. In combination with the multiple firmness pillows of the present invention, with the firmer materials positioned facing one another to provide good support for the face of the prone user, the pillow covers and pillowcases of the '904 U.S. Patent provide superior comfort and ease of breathing for the user thereof. The present multiple firmness pillows may make use of various loose or cohesive fill materials, such as relatively loose foam material and feathers or synthetic fiber fill material, or more cohesive fill, such as different densities of molded or cut to shape open or closed cell foam material, as desired.

Accordingly, it is a principal object of the invention to provide an improved multiple firmness pillow for supporting the face of a prone person, with the present pillow also providing comfort for persons resting in other than prone positions as well.

It is another object of the invention to provide an improved multiple firmness pillow which is particularly adaptable for use in pairs with the pillow covers and pillowcases described in U.S. Pat. No. 5,864,904, issued to the present inventor.

It is a further object of the invention to provide an improved multiple firmness pillow having a generally square or rectangular shape, and having a relatively firmer fill material filling one diagonal corner thereof, with a relatively softer fill material disposed throughout the balance of the pillow.

An additional object of the invention is to provide an improved multiple firmness pillow which may utilize either loose or cohesive fill materials, as desired.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a multiple firmness pillow, with a portion of the pillow having a fill material of greater firmness than the remainder of the pillow. Two such pillows, when placed close together with the portions having the firmer fill material facing one another, provide excellent support for the head of a person using the pillows, serving to hold the head well clear of the underlying surface. This is particularly valuable to a prone sleeper, who may use the present multiple firmness pillow to sleep face down with a pair of the pillows supporting the user's face well clear of the mattress or other underlying surface and providing a breathing space for the prone sleeper.

Figure 1:
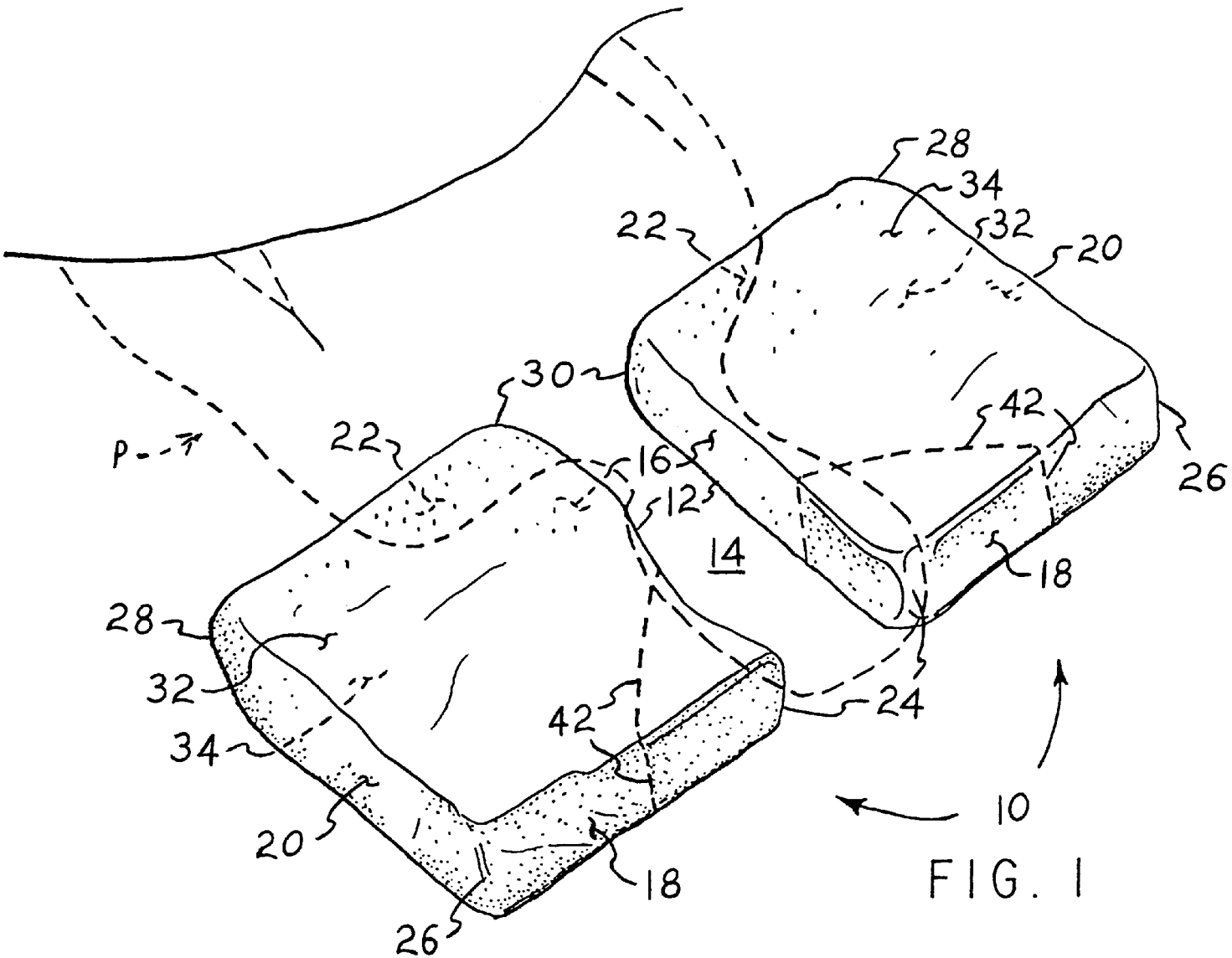
FIG. 1 is an environmental perspective view of a pair of the present multiple firmness pillows in use, showing their support of the head of a prone person.
Figure 2:
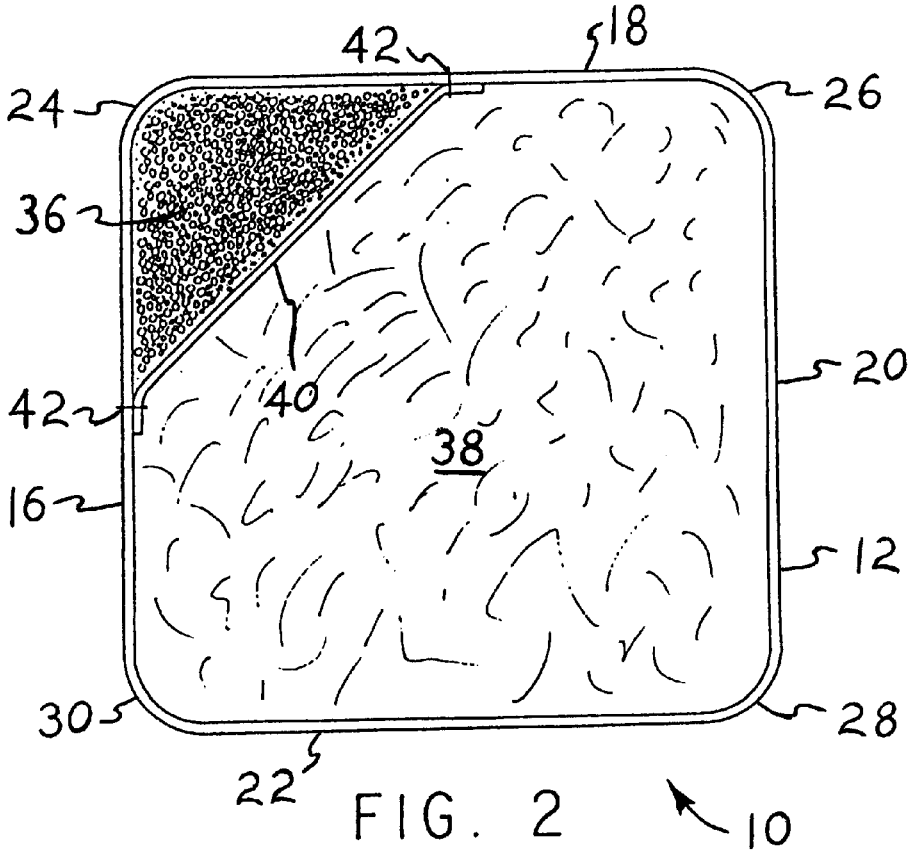
FIG. 2 is a plan view in section of a first embodiment of the present pillow, utilizing loose fill material of two different firmnesses and showing their disposal within the pillow.
Figure 3:
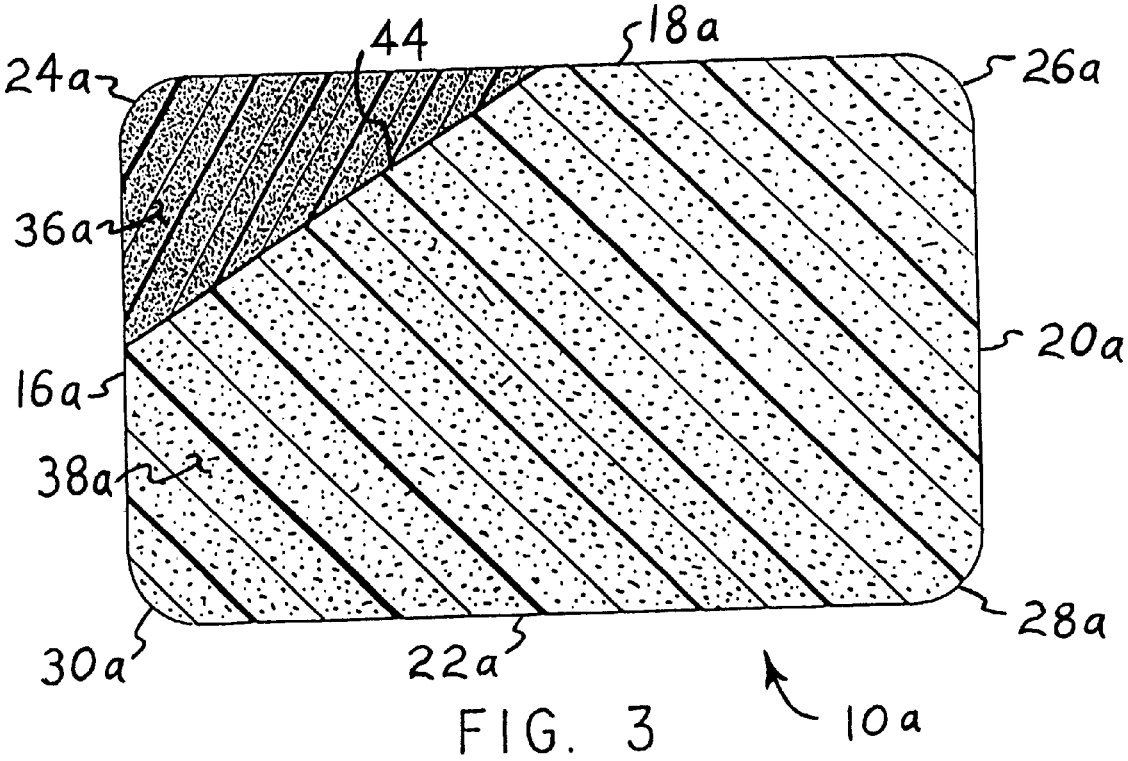
FIG. 3 is a plan view in section of a second embodiment of the present pillow, showing the use of cohesive fill materials.

FIG. 1 provides a perspective view of a pair of the present multiple firmness pillows in use, with the pillows each being essentially identical and each indicated by the reference numeral 10 throughout the drawings. The pillows 10 may be configured in any practicable shape, but are preferably formed with a casing 12 having a generally square shape as shown in FIGS. 1 and 2, or alternatively a rectangular shape as illustrated in the embodiment of FIG. 3. These square and rectangular shapes are particularly well suited for removable installation in the interconnected pillowcases described in U.S. Pat. No. 5,864,904 issued on Feb. 2, 1999 to the present inventor, and incorporated herein by reference. Accordingly, various details of the '904 Patent discussed below, need not be shown in detail in the drawings.

In that issued patent, a pair of pillow covers includes an interconnecting tether or strap therebetween, with the tether providing a maximum separation between the two pillow covers of only a few inches at most. The length of the tether, in fact, defines a breathing channel 14 between the two pillows 10 which are contained in the interconnected pillow covers, with the width of the channel 14 being defined by the length of the tether and thus the spacing between the two interconnected pillow covers. The two interconnected pillow covers may be removably covered with specially configured first and second pillowcases corresponding to the first and second pillowcases, as disclosed in the issued '904 Patent, with the cases providing coverage for at least the tops and sides of the two pillow covers and also including an opening sufficient for clearance for the interconnecting strap or tether extending between the two pillow covers.

The outer casing 12 of each of the present multiple firmness pillows 10 is preferably formed of a relatively soft and flexible fabric material (cotton, etc.). The casing 12 has first through fourth side panels, respectively 16 through 22, which define first through fourth corners, respectively 24 through 30. The extent of the four sides 16 through 22 also define the opposite first and second surfaces 32 and 34 of the casings 12, and thus the pillows 10.

Each of the pillows 10 includes two different fill materials, with the two fill materials each having different firmnesses from one another. (The materials may be formed of the same substance, e.g., polyester fiber, with the firmer material being packed more tightly than the softer material.) FIG. 2 provides a plan view in section of the multiple firmness pillow 10 of the present invention and showing two different fill materials therein. A first fill material 36, has a relatively firm constitution sufficient for supporting the head of a person well clear of an underlying surface (bedding atop a mattress, etc.), particularly when two such pillows 10 are positioned closely together as shown in FIG. 1. The second fill material 38 need only have a firmness somewhat less than the firmness of the first fill material 36, i. e., about the firmness of a conventional pillow.

The pillow 10 has a first fill 36 area within the first corner 24 of the casing 12, with the first fill area extending generally diagonally from about the midpoint of the first side 16 to about the midpoint of the adjacent second side 18. This first fill 36 area thus takes up about one eighth of the pillow 10, by area and by volume. The area for the second type of fill 38 fills the remainder of the pillow 10. The first fill 36 and second fill 38 areas extend from the first surface 32 to the opposite second surface 34 of the casing 12. In other words, a section taken through the present multiple firmness pillow 10 generally parallel to the two opposite surfaces 32 and 34, would be substantially identical regardless of the depth through the pillow 10.

The two fill materials may be any suitable materials, as desired. For example, the fill materials 36 and 38 may be a loose particulate material, such as a shredded or other particulate synthetic resilient foam material, with the softer fill material 38 comprising feathers, loose synthetic fiber material, etc. The relative firmness of the two pillow sections may be altered by adjusting the density or packing of the two different fill materials 36 and 38 as well, in lieu of or in addition to providing different materials or similar materials of different firmnesses.

Such loose fill materials 36 and 38 will require some means of keeping them separate from one another and avoiding mixing. The pillow 10 provides such by means of a flexible divider 40 (fabric, etc.) as shown in FIG. 2, which extends between the two fill areas, generally diagonally to connect the midpoints of the two sides 16 and 18 adjacent the first corner 24. The divider 40 defines a separation plane between the two fill materials 36 and 38, and extends completely between the first and second surfaces 32 and 34 of the pillow casing 12 (shown in FIG. 1). The divider 40 may be secured in place by stitching 42 (FIG. 1), or other suitable means as desired.

Alternatively, cohesive fill materials (i.e., materials having body sufficient to preclude any need for an outer casing, divider, etc.) may be used as desired. FIG. 3 illustrates an alternative embodiment in which the multiple firmness pillow 10*a* is formed of cohesive first and second fill materials 36*a* and 38*a* each formed of a single unit of molded, cut, or otherwise shaped resilient foam material. The firmer material 36*a* may comprise a closed cell foam, while the less firm material 38*a* may comprise an open cell foam, if so desired. Different cell diameters and other factors may be used to adjust the firmness of the two different fill materials 36*a* and 38*a*, as desired.

It will be noted that no divider is provided between the two different fill materials 36*a* and 38*a* of the rectangular pillow 10*a* of FIG. 3. No such divider is required when such cohesive materials are used for the fill 36*a* and 38*a*, as their body does not allow them to mix together, as would be the case with loose fill materials. The interface between the two different materials 36*a* and 38*a* defines the separation plane 44 between the two fill materials 36*a* and 38*a*. (It should be noted that while no pillow casing is shown for FIG. 3, as none is absolutely required, that a casing is preferably provided in the manner of the casing 12 of the pillow 10 of FIGS. 1 and 2, but without the divider.)

The multiple firmness pillow 10*a* of FIG. 3 differs from the pillow 10 of FIGS. 1 and 2 in other ways as well. Both of the pillow embodiments 10 and 10*a* are rectangular, in that a rectangle is defined as having four sides, with opposite sides parallel and adjacent sides normal to one another. Thus, the square pillow 10 of FIGS. 1 and 2 is rectangular, but is a special case in which all four sides are of equal length to form a square. The pillow 10*a* of FIG. 3 is formed in the more general shape of a rectangle, with adjacent sides having different lengths. Otherwise, the pillow 10*a* of FIG. 3 is similar to the pillow 10 of FIGS. 1 and 2, having four sides 16*a* through 22*a* and four corners 24*a* through 30*a*, with the area of firmer material 36*a* extending across the first corner 24*a* to the midpoints of the two adjacent sides 16*a* and 18*a*.

The present multiple firmness pillow, in whichever embodiment, is used generally as shown in FIG. 1. Two such pillows (e.g., the square pillows 10 of FIGS. 1 and 2) are positioned closely adjacent to one another, but with a channel 14 therebetween to allow a breathing space or channel for a prone person P resting his or her head thereon. It will be noted that the two pillows 10 shown in FIG. 1 are positioned in a mirror image to one another, i. e., their first sides 16 and areas of firmer material are facing one another, with the first surface 32 of the right hand pillow (i.e., to the right of the prone person P) facing upwardly and the second surface 34 of that pillow facing downwardly, while the opposite pillow has the first surface 32 facing downwardly and the second surface facing upwardly.

The two pillows 10 are held in the proper spacing and relationship to one another by means of the interconnected pillow covers disclosed in the '904 U.S. Patent to the present inventor, and discussed further above. The specially formed pillowcases disclosed in the '904 Patent may also be used, as desired, with it being understood that the pillow covers and cases may be formed to fit the rectangular multiple firmness pillow 10*a* of FIG. 3 of the present disclosure, as well.

When the two pillows 10 are arranged generally as shown in FIG. 1, the user of the pillows may recline or lie in a prone position on the bed or other resting surface and position his or her head atop the two adjacent sides 16 of the pillows, with his or her face generally between the two pillows 10 and facing the breathing channel 14 therebetween. The head of the prone person P is supported well above the underlying surface, by the two adjacent firmer fill material areas of the two mirror image pillows 10. Yet, the softer fill areas comprising the greater volume of the pillows, allows the prone person to rest comfortably with his or her shoulders resting thereon and substantially compressing the softer material in the manner of a conventional pillow In summary, the present multiple firmness pillow provides a much needed means for a person preferring to sleep or rest in a prone position, to be able to breathe freely without need to turn their neck and head to the side. The greater comfort provided for a prone person by resting with the face in a downward orientation, greatly alleviates neck muscle strain and other problems which often occur when a person sleeps with the neck and head turned for a substantial period. The present pillow is particularly useful when used with the interconnected pillow covers and pillowcases of the '904 U.S. Patent, as noted further above, and will find great favor among persons preferring to rest in a prone position.

It is to be understood that the present invention is not limited to the embodiments described above, but encompasses any and all embodiments within the scope of the following claims.

I claim:

1. A multiple firmness pillow, comprising: a generally rectangular casing having first, second, third, and fourth sides, and having first, second, third, and fourth corners defined by said sides, and first and second surfaces defined by said sides;

first and second fill material contained within said casing;

said first fill material being disposed within said first corner and extending to a separation plane extending between said first and said second sides of said casing, and further extending between said first and said second surfaces;

said second fill material filling a remainder of said casing; and said first fill material having a firmness sufficient for supporting a head of a person well clear of an underlying surface and said second fill material having a firmness less than that of said first fill material.

2. The multiple firmness pillow according to claim 1, wherein said separation plane between said first and second fill material forms a diagonal extending substantially between a midpoint of said first side and a midpoint of said second side of said casing.

3. The multiple firmness pillow according to claim 1, wherein said first and second fill material each comprise loose particulate fill material, and said separation plane between said first and second fill material comprises a flexible divider completely separating said first and second fill material.

4. The multiple firmness pillow according to claim 3, wherein said first and second fill material are selected from the group consisting of shredded resilient foam material, synthetic fiber material, and feathers.

5. The multiple firmness pillow according to claim 1, wherein said first and second fill material each comprise a cohesive fill material.

6. The multiple firmness pillow according to claim 5, wherein said first and second fill material each comprise a single unit of shaped resilient foam material.

7. The multiple firmness pillow according to claim 1, wherein said casing is fabric.

8. The multiple firmness pillow according to claim 1, wherein said casing is substantially square.

* * * * *